US006761217B1

(12) United States Patent
McGarian

(10) Patent No.: US 6,761,217 B1
(45) Date of Patent: Jul. 13, 2004

(54) DOWNHOLE LATCH ASSEMBLY AND METHOD OF USING THE SAME

(75) Inventor: Bruce McGarian, Aberdeen (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/070,990

(22) PCT Filed: Sep. 18, 2000

(86) PCT No.: PCT/GB00/03574

§ 371 (c)(1),
(2), (4) Date: Mar. 14, 2002

(87) PCT Pub. No.: WO01/20118

PCT Pub. Date: Mar. 22, 2001

(30) Foreign Application Priority Data

Sep. 16, 1999 (GB) ..... 9921859

(51) Int. Cl.[7] ..... E21B 7/08; E21B 23/06

(52) U.S. Cl. ..... 166/255.3; 166/382; 166/117.6; 166/117.5; 175/81

(58) Field of Search ..... 166/382, 380, 166/117.5, 117.6, 50, 255.2, 255.3; 175/77, 78, 79, 81, 82, 61

(56) References Cited

U.S. PATENT DOCUMENTS 5,425,419 A * 6/1995 Sieber ..... 166/206
5,427,177 A * 6/1995 Jordan et al. ..... 166/50
5,458,209 A * 10/1995 Hayes et al. ..... 175/61
5,467,819 A * 11/1995 Braddick ..... 166/117.6
5,566,762 A * 10/1996 Braddick et al. ..... 166/382
5,615,740 A 4/1997 Comeau et al. ..... 166/380
5,704,437 A 1/1998 Murray ..... 175/61
5,732,773 A * 3/1998 Parks et al. ..... 166/117.5
5,785,133 A * 7/1998 Murray et al. ..... 175/61
5,884,698 A * 3/1999 Hughes et al. ..... 166/117.6
6,012,516 A 1/2000 Brunet ..... 166/50
6,012,527 A * 1/2000 Nitis et al. ..... 166/313
6,089,319 A 7/2000 Singleton ..... 166/298
6,209,648 B1 * 4/2001 Ohmer et al. ..... 166/313
6,488,095 B2 * 12/2002 Buytaert ..... 166/382

* cited by examiner

*Primary Examiner*—David Bagnell
*Assistant Examiner*—Shane Bomar
(74) *Attorney, Agent, or Firm*—Dykema Gossett PLLC

(57) ABSTRACT

Downhole apparatus for locating equipment in a required depth and orientation within a well bore, the apparatus comprising a body and a latching member mounted on said body so as to be movable between a retracted position and an extended position, wherein the latching member is adapted to project into a latch profile provided in a casing of a well bore when in the extended position in such a way that it tends to slide along a well bore casing profile portion so as to locate the latching member centrally before preventing movement of the downhole apparatus in the direction of pressing, the latching member being yet further adapted to engage a second portion of said profile in such a way that when pressed against it, the latching member is moved towards the retracted position so as to permit movement of the downhole apparatus past said latch profile.

5 Claims, 16 Drawing Sheets

DOWNHOLE LATCH ASSEMBLY AND METHOD OF USING THE SAME

BACKGROUND OF INVENTION

The present invention relates to a method and apparatus for use in downhole oil and gas drilling operations and, particularly, but not exclusively, to a method and apparatus for locating downhole equipment in a required orientation and at a required depth within a borehole.

BRIEF DESCRIPTION OF THE DRAWINGS

Embodiments of the present invention will now be described with reference to the accompanying drawings, in which.

DETAILED DESCRIPTION OF THE PREFERRED EMBODIMENTS

Figure 1:
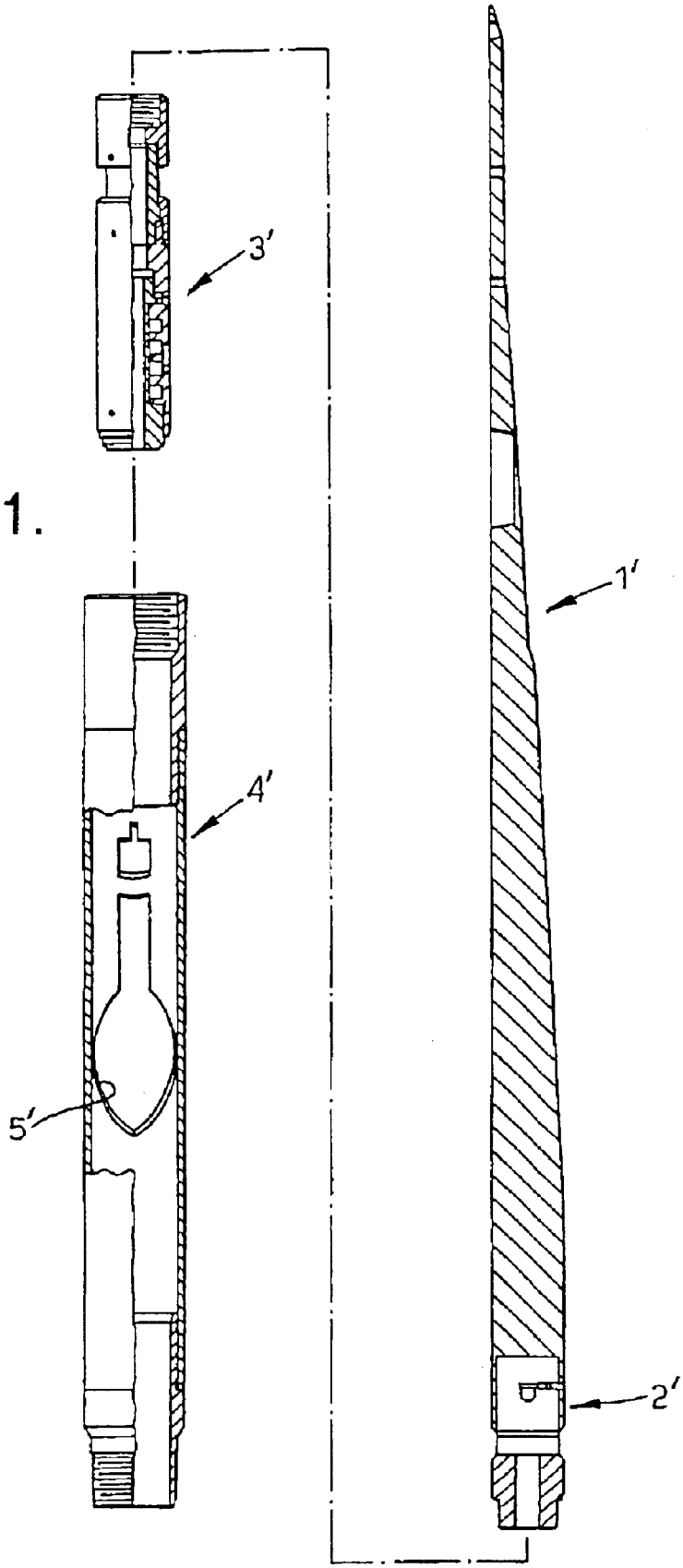
FIG. 1 shows an assembly of a whipstock 1', hinge connector 2' and latch 3' running into a well bore casing provided with a latch coupling 4' provided with a latch profile 5', wherein the assembly is in accordance with the present invention.
Figure 2:
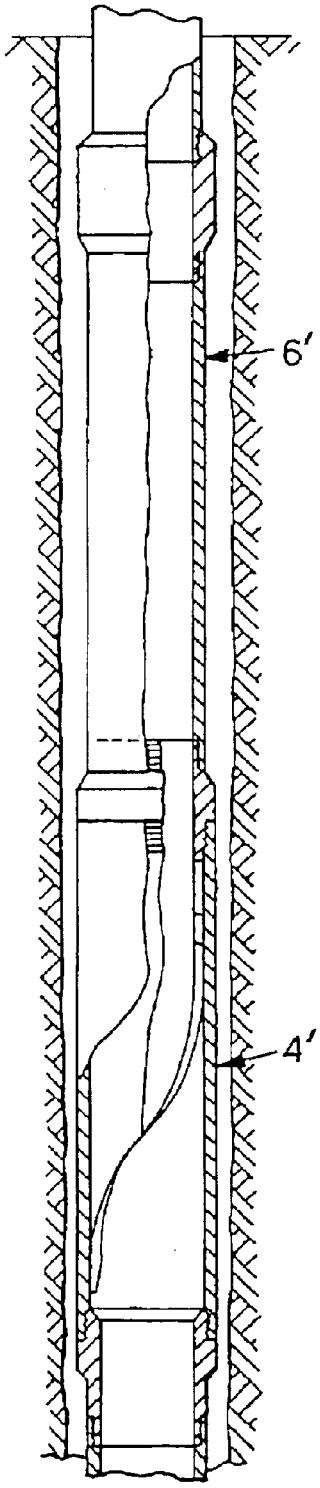
FIG. 2 shows a partial cross-section view of a well bore casing 6' provided with a latch coupling 4'.
Figure 3:
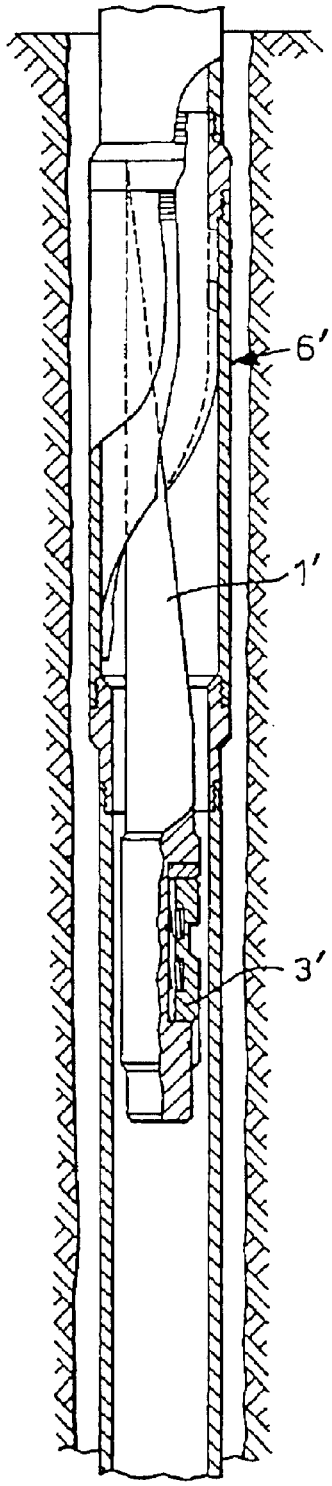
FIG. 3 shows the assembly of FIG. 1 being r run into the well bore casing 6' of FIG. 2.
Figure 4:
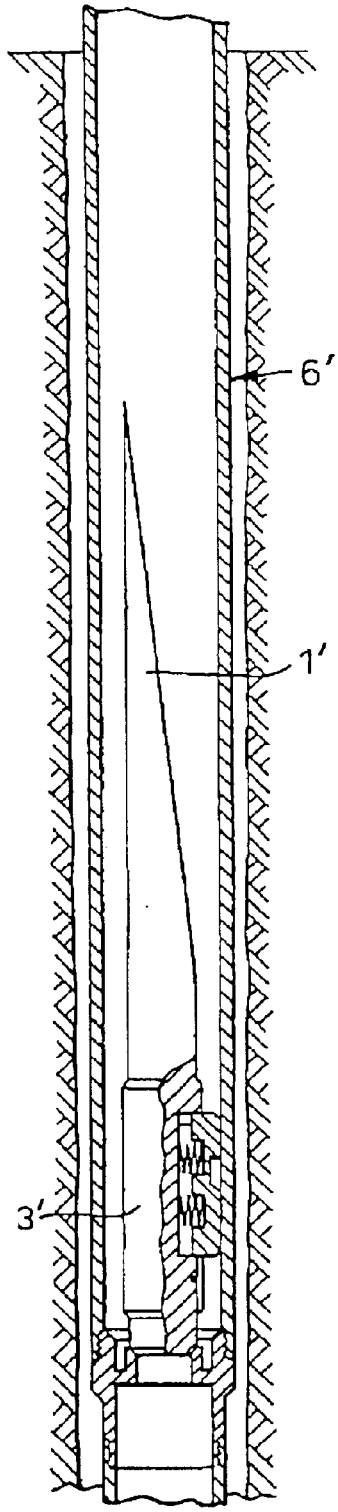
FIG. 4 shows the latch 3 having being tripped within the well bore casing 6'.
Figure 5:
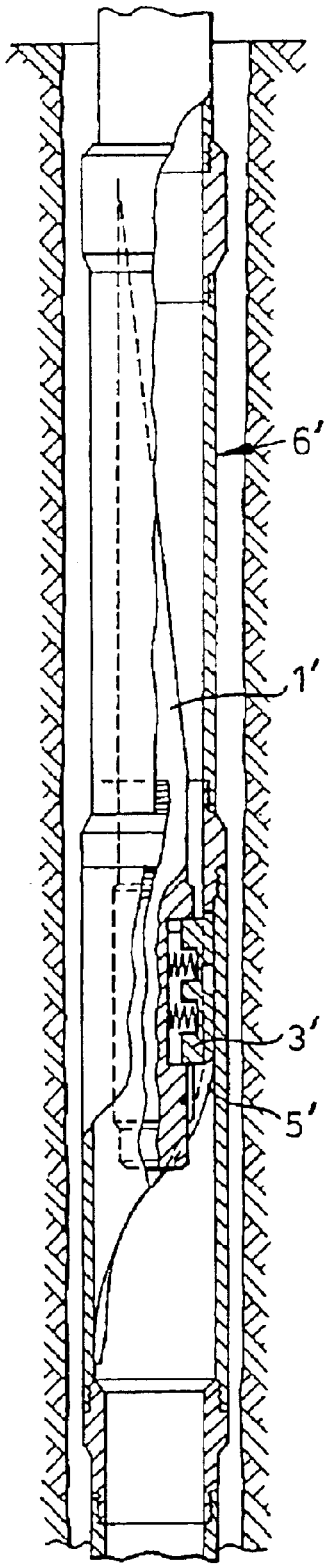
FIG. 5 shows the assembly having being pulled up-hole so that the latch 3' is biased into the latch profile 5' so as to prevent further up-hole movement of the assembly and thereby position the assembly at a required depth and orientation.
Figure 6:
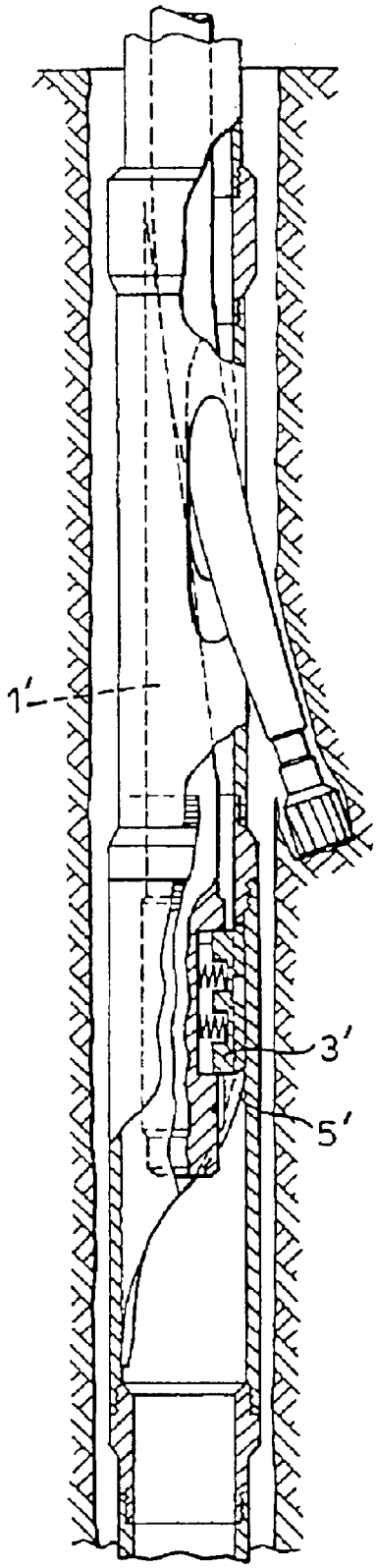
FIG. 6 shows a subsequent lateral bore hole drilling operation with the whipstock 1' having being correctly positioned by virtue of the latch 3' locating in the latch profile 5'.

The apparatus of the present invention was originally devised for the second lateral leg in a seven leg multilateral well where leg one has been drilled out of the shoe, and where the latch coupling (provided with a latch profile for receiving a latch) will form a reference point in the liner/casing. It is proposed that 7" liner is run and suspended off bottom in 8½" hole with the lower end cemented around the shoe. Close to the bottom of the liner a 7" latch coupling is installed, if necessary with a biased edge for re-entry purposes. The plan is to use the latch and coupling in conjunction with a hydraulic (or mechanical) set retrievable packer to isolate the lower bore from losses. In this application of the system, trials of entry and re-entry of the latch into the latch profile will be performed.

Once the liner has been run and set with the first leg drilled, it will be necessary to jet the profile in the latch coupling clean. It is proposed the jetting operation will be combined with a survey run which would eliminate the need to run our hydraulic swivel allowing us to independently orientate the whip relative to the coupling orientation. (If the latch did not have any orientation profile, we could use the hydraulic swivel). To enable this test, we plan to attempt to latch into the profile before jetting to determine the criticality of the operation, and then to disengage, jet the profile clean, re-engage, survey and come out of hole. In the event that we engage, it may not be necessary to jet the profile, however this should be done as a matter of course and due consideration given to whether it is safe to eliminate the jet run. Should more than one latch coupling be installed, surveys can be taken consecutively as the string is pulled out of hole. Note that all the coupling profiles are identical and the same latch assembly can be used for this purpose.

The proposed bottom hole assembly for this phase of the operation would be:

Orienting Latch Assembly
ACC Tool
Drill Pipe Spacer
MCBPV
NMDC
MWD

The latch could be hydraulically configured to operate at depth in response to the pressure drop across the ACC tool before survey. The bypass valve would be closed to enable this feature to be activated. A survey would be possible at this time too, noting of course that the latch would have been scribed to the MWD offset. However this system application requires that we need to isolate the well bore, therefore it is desirable that the latch is mechanical, and is tripped on surface before running in hole. There will not be a bottom to activate the system down hole.

Assuming that the wash, latch and survey operation has been completed satisfactorily, the next phase of the operation is to run the latch and a whipstock with milling assembly preconfigured to suit the coupling orientation. The milling assembly will have the torque through shear boll design and horse shoe adapter on the head. The hydraulic retrievable packer will have a lower connection to allow it to interface with the latch sub. Conflict of setting pressure for the packer and tripping pressure for the latch will be manifested at this point. Hydraulically, we need to activate the latch down hole independently of the packer without pre-setting the packer before we are engaged in the latch profile. To eliminate the possibility of a mis-run we should therefore consider that the latch is mechanically activated on surface, and spring biased in the engaged position to allow down hole orientation and engagement. We therefore need to rotate through the latch coupling and reciprocate if we do not have a biased edge to cam the assembly round. Alternatively, we have a biased edge, pass through the coupling and pull back to engage.

To this end, we have a proven shear bolt system as described with the horse shoe above. The latch dog system will be able to cope with frictional contact down hole, and the only other area for concern would be to ensure that drilling solids or other debris lying on the low side of the well bore will not compromise the latch activation.

The proposed bottom hole assembly for this phase of the operation would be:

Orienting Latch Assembly

Hydraulic Retrievable Packstock Assembly

Trackmaster Mill

Running Tool

Drill Pipe Flex Joint

MCBPV

NMDC

MWD

Once the window has been milled, and the lateral drilled, the assembly will be retrieved in the normal fashion, utilising the hook, and a re-entry run established using another whipstock or deflector system. The mill/running tool will be used to confirm exit of the window. The system will be recovered to surface and the subsequent operations will continue in the normal method using the retrievable packstock system.

The proposed hole assembly for this phase of the operation would be:

Orienting Latch Assembly

Whipstock or deflector

Trackmaster Mill

Drill Pipe Flex Joint

NMDC

MWD

System requirements may be refined to drop out equipment as and when confidence of the operation is established.

Subject to the success of the system it is understood consideration will be given to utilising more latch couplings in the wells.

Other points of note for implementation of the system:

The wiper plug necessary for the cementing operation has to be a dual wiper, with sufficient space out between the wipers to ensure the wipers straddle the latch profile and that they get pumped across without pressure loss and subsequent fluid bypass. This is especially important with regard to the latch incorporating the biased edge. If no biased edge is utilised, the need for two wipers is eliminated.

The latch coupling is 7¾" OD with the equivalent casing weight ID, so for 7' 23#=6.375' ID.

The latch coupling length with biased edge will be about 8ft, and without biased edge, 4ft, note these lengths may vary.

The latch coupling material yield strength will be 80,000psi (L80 equivalent), and connections will be LTC.

Further consideration is necessary with regard to the use of composite casing joints versus steel joints and drilling out using the PDC drill ahead system.

Figure 11:
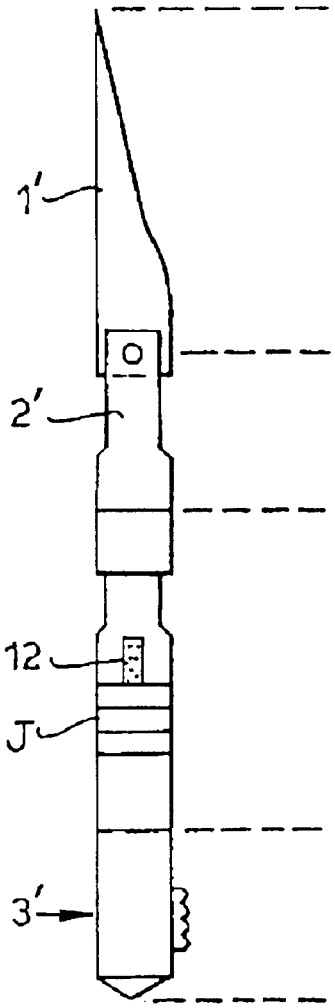
FIG. 11 shows schematically the packer of FIG. 7 arranged with the whipstock 1', hinge connector 2 and latch 3 shown in FIG. 1.
Figure 12:
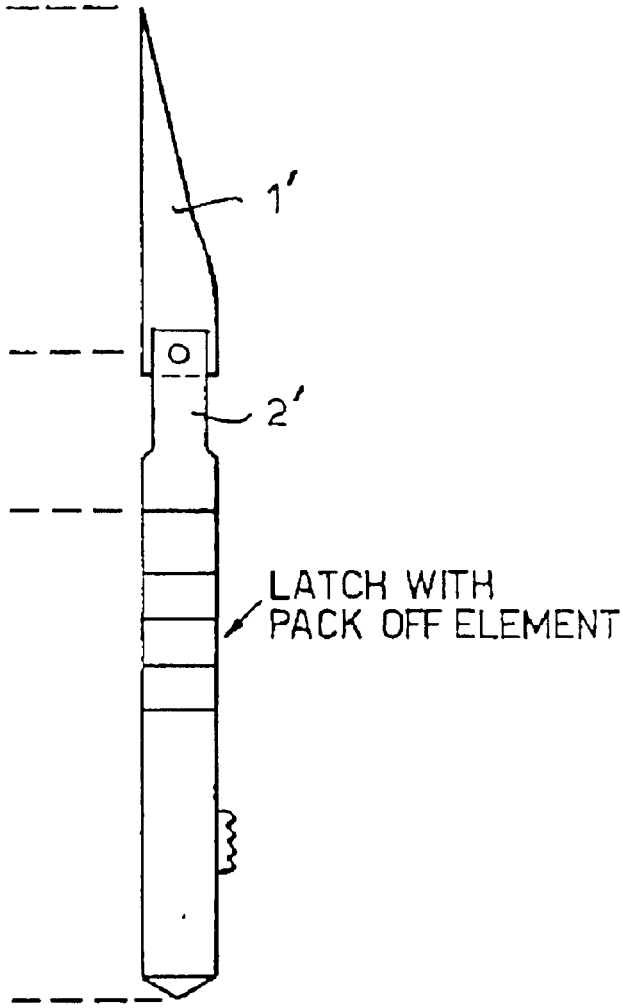
FIG. 12 shows schematically the whipstock 6' and hinge connector 2' of FIG. 1 connected to an integral packer/latch assembly, wherein the packer element is located up-hole of the slips.
Figure 13:
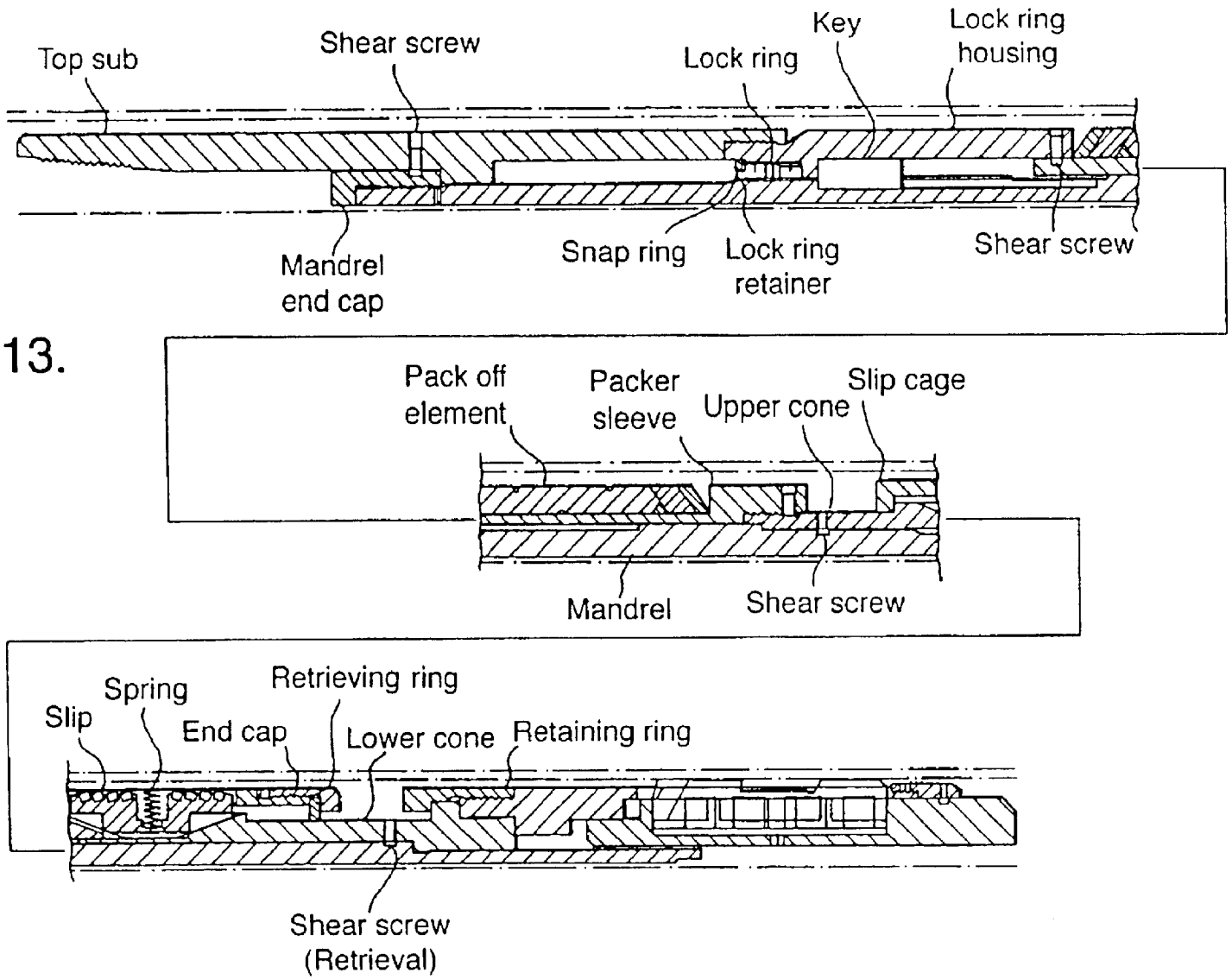
FIG. 13 shows a cross-sectional view of a mechanically settable integral packer/latch assembly for use in the arrangement shown in FIG. 12.
Figure 14:
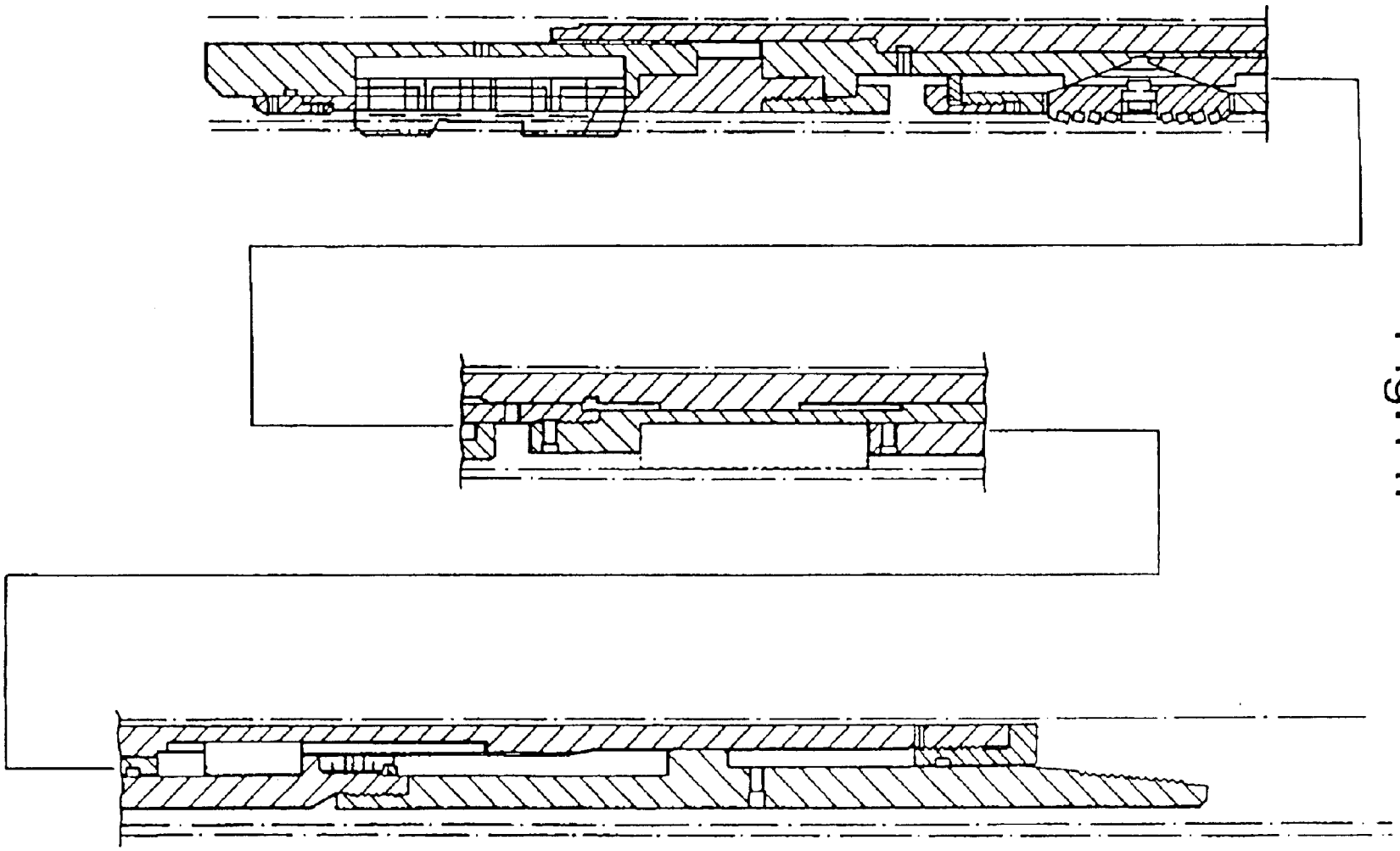
FIGS. 14-17 show the integral packer/latch assembly of FIG. 13 being run in hole and latching into a latch profile.
Figure 15:
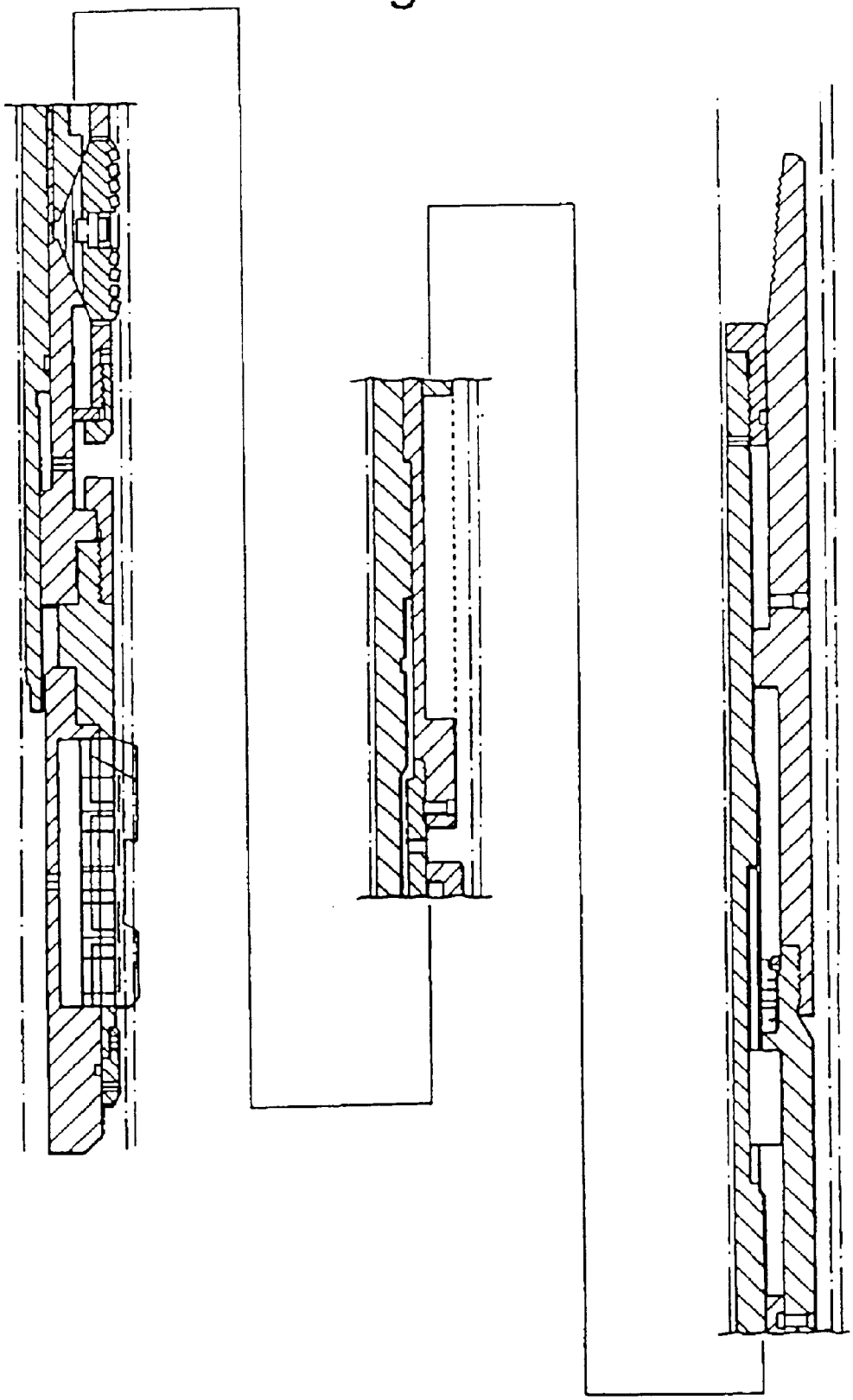
Figure 16:
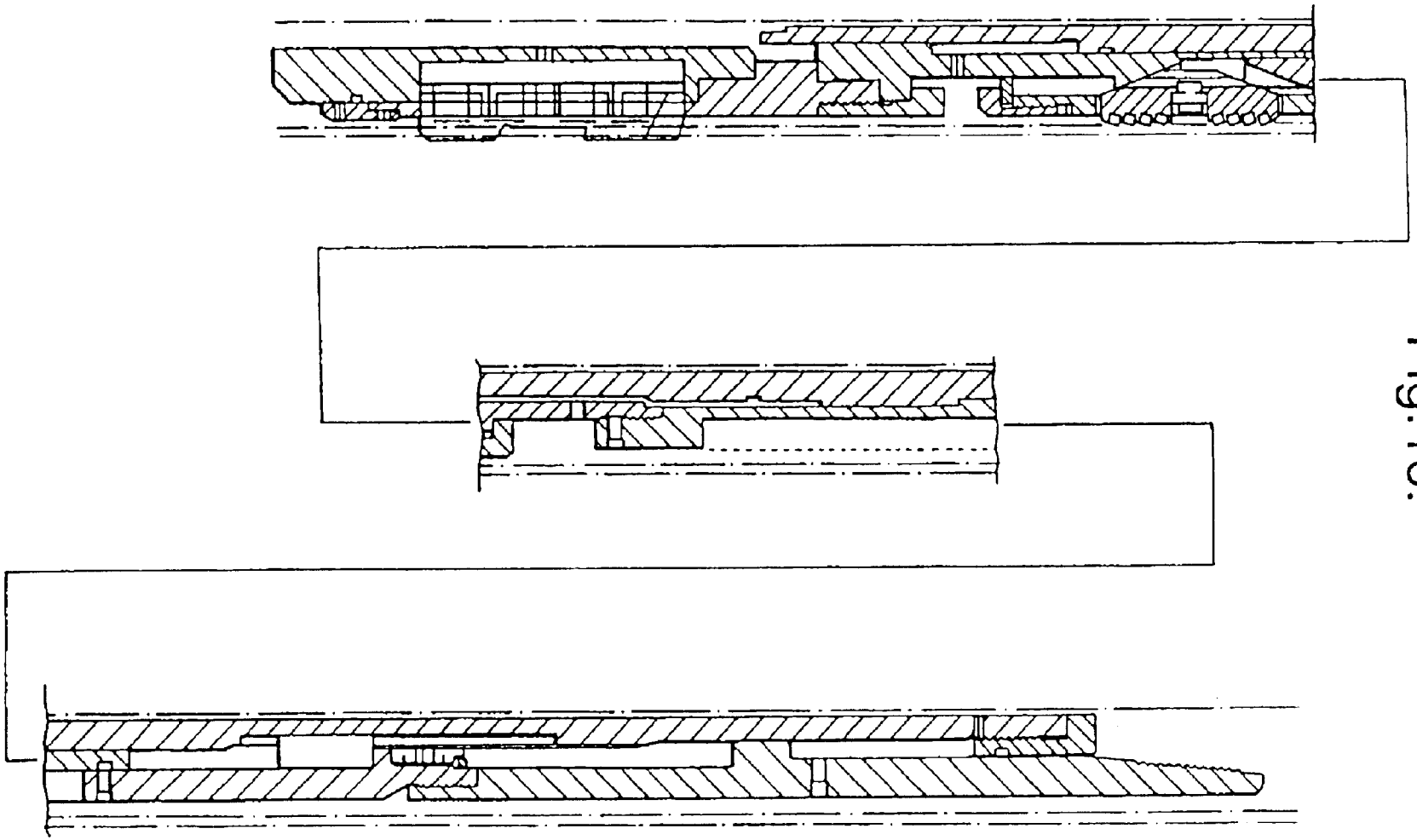
Figure 17:
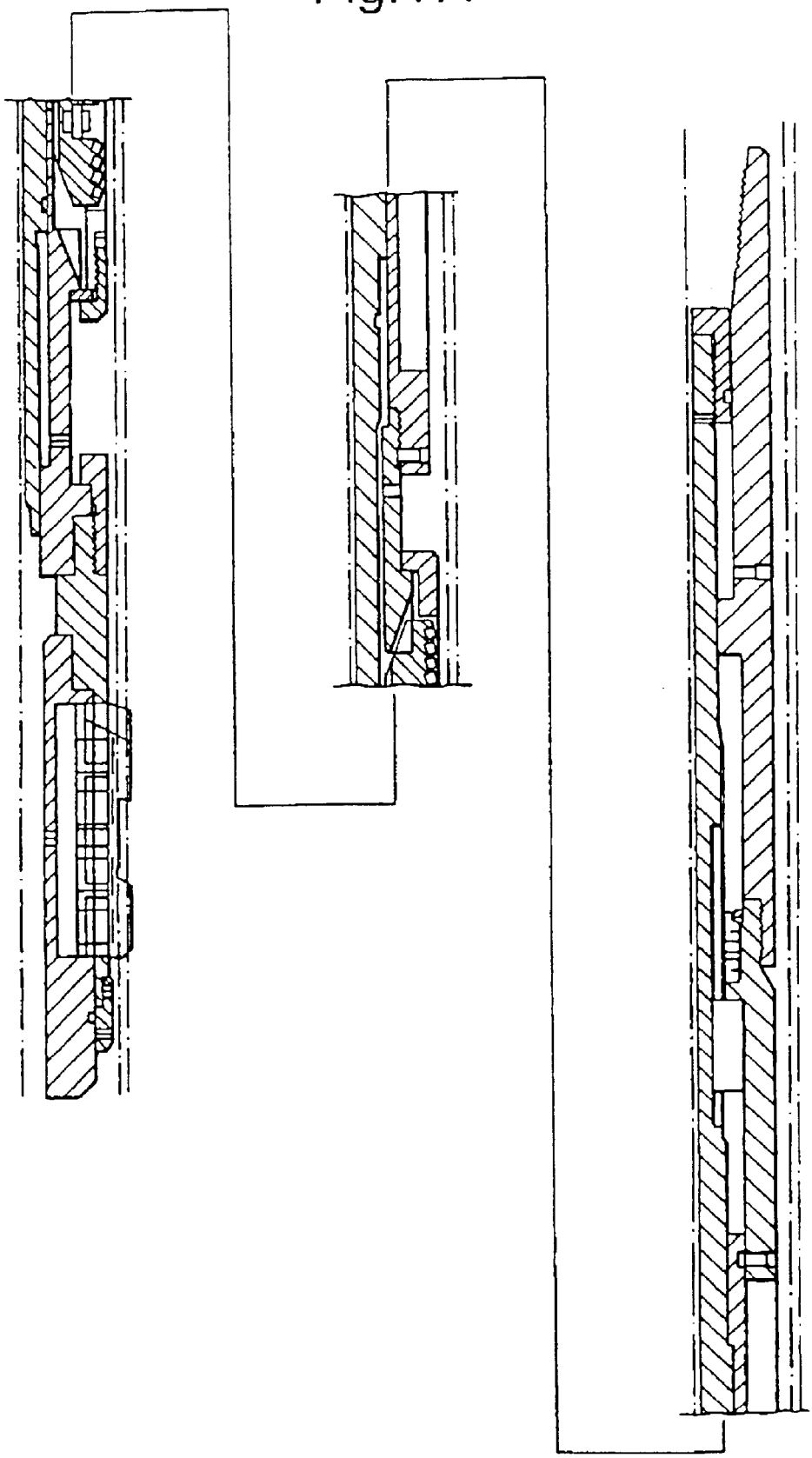
Figure 18:
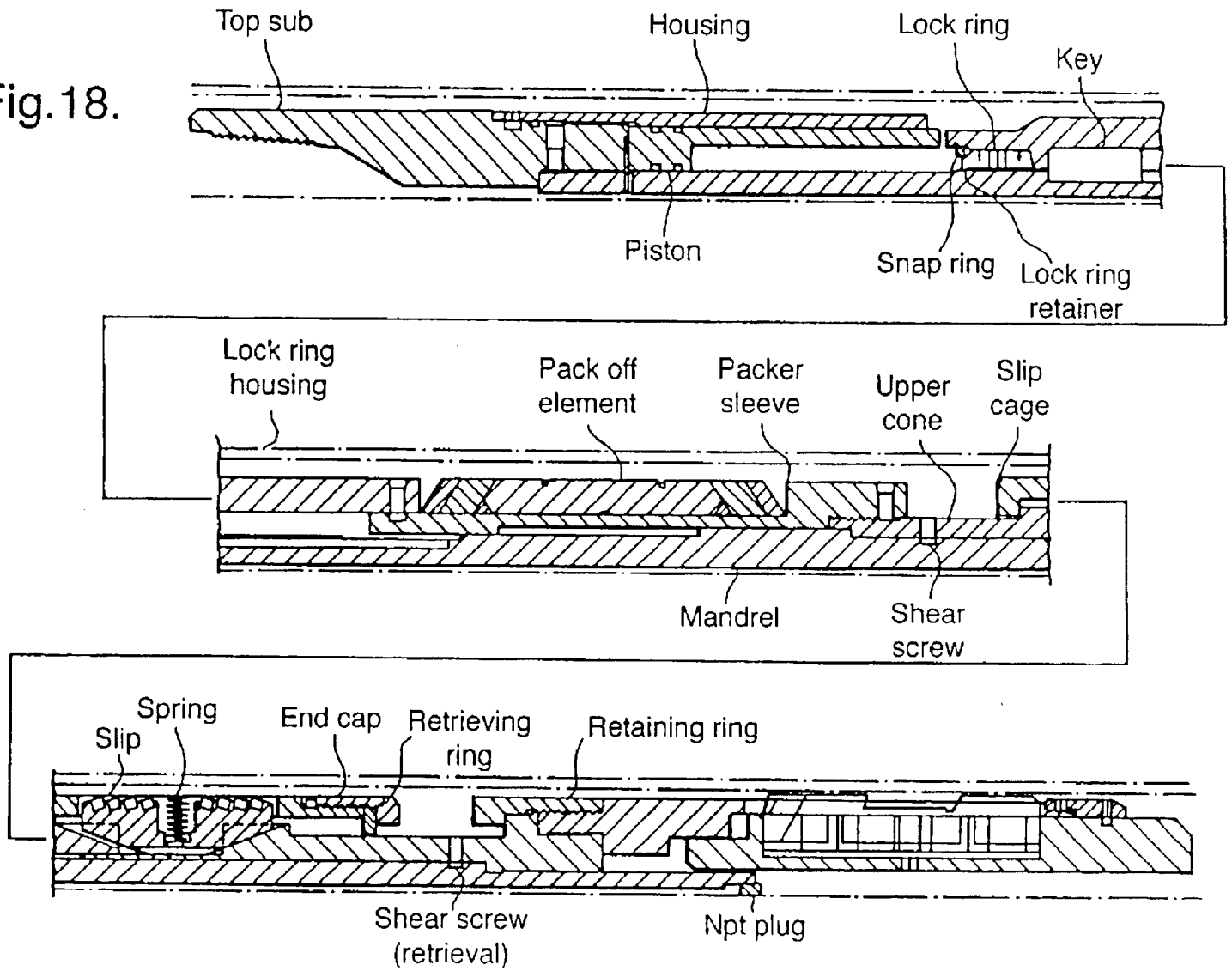
FIG. 18 shows a cross-sectional view of a hydraulically settable integral packer/latch assembly for use in the arrangement shown in FIG. 12.
Figure 19:
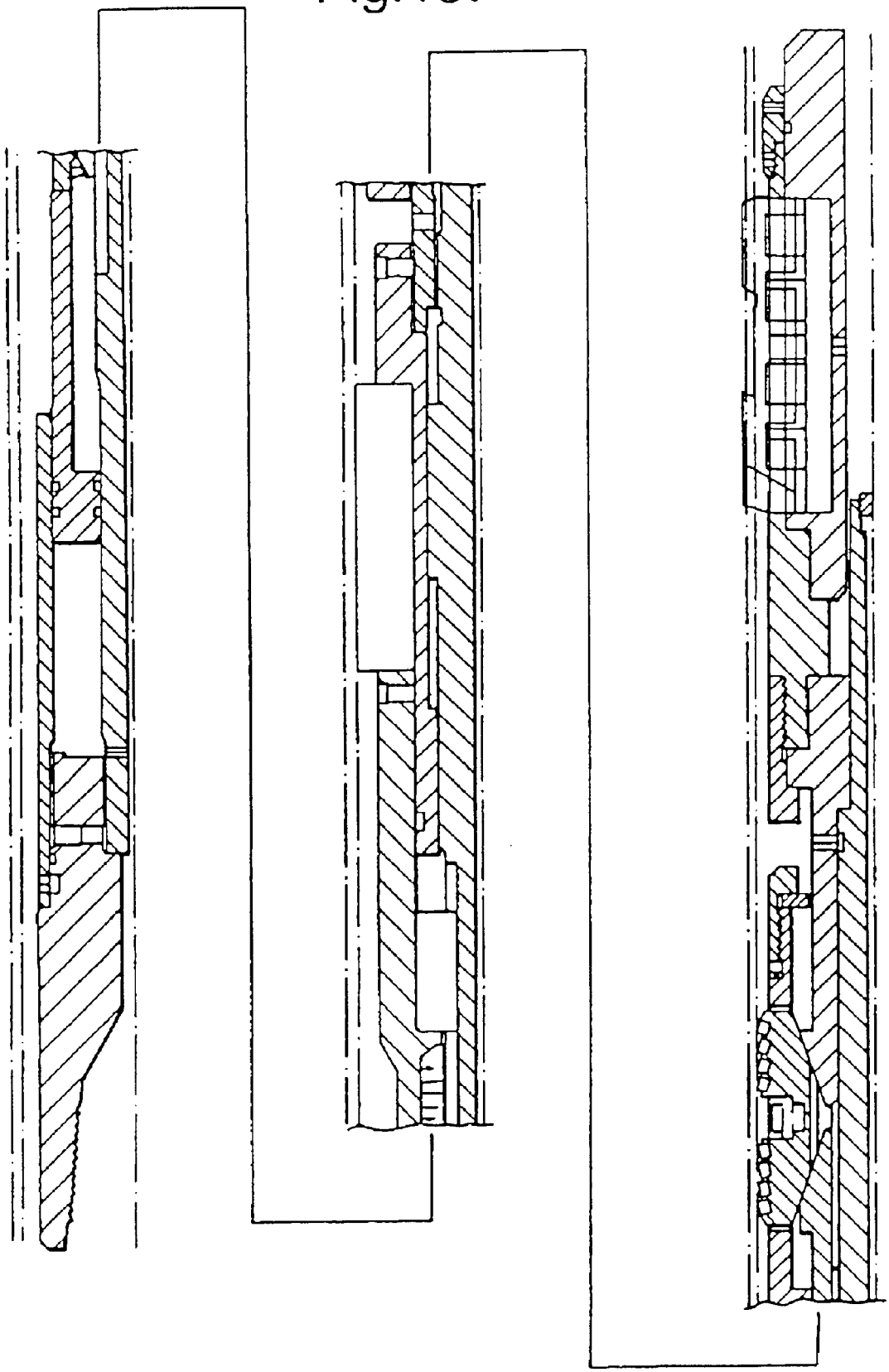
FIGS. 19-22 show the integral packer/latch assembly of FIG. 13 being run in hole and latching into a latch profile.
Figure 20:
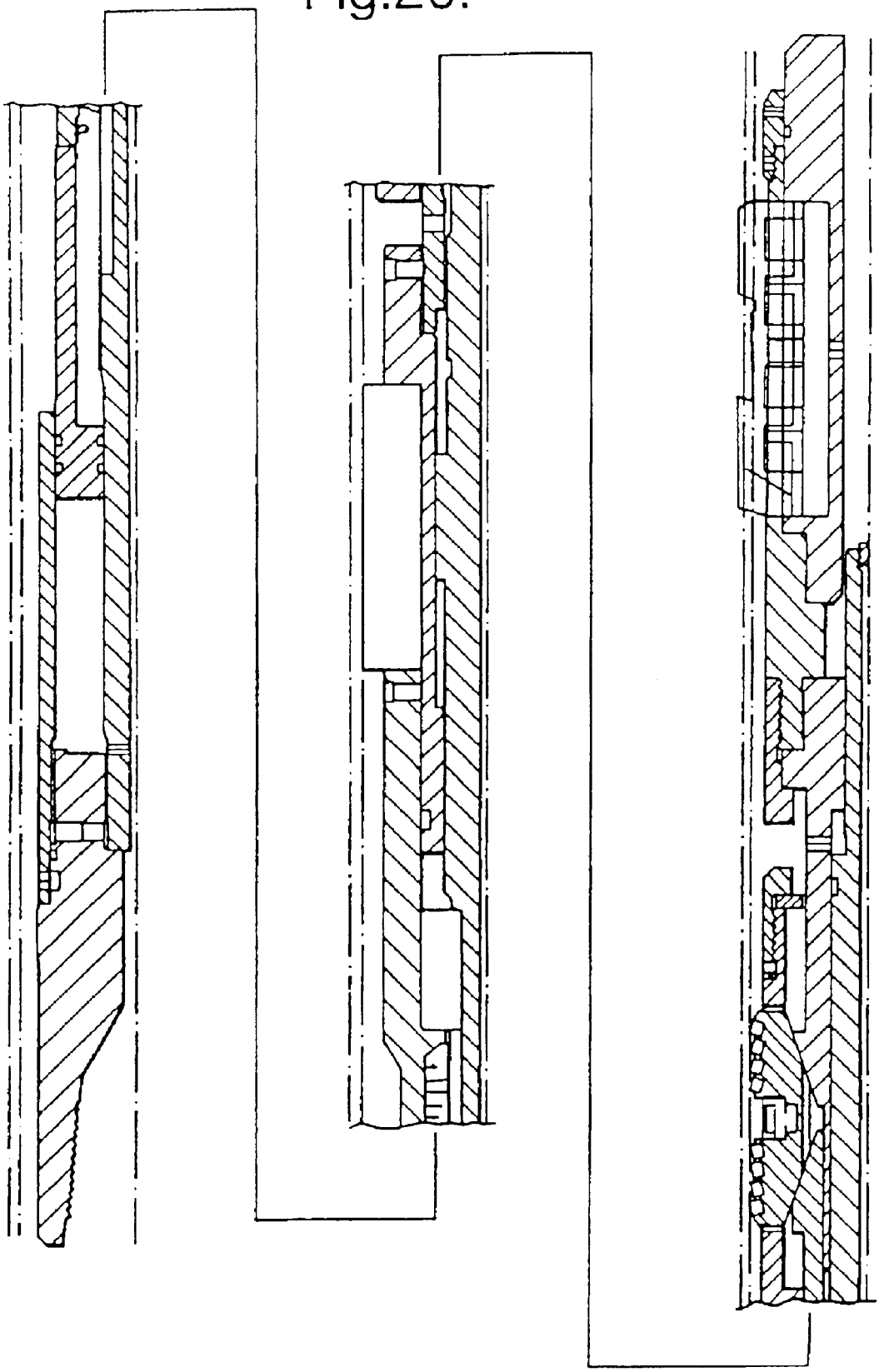
Figure 21:
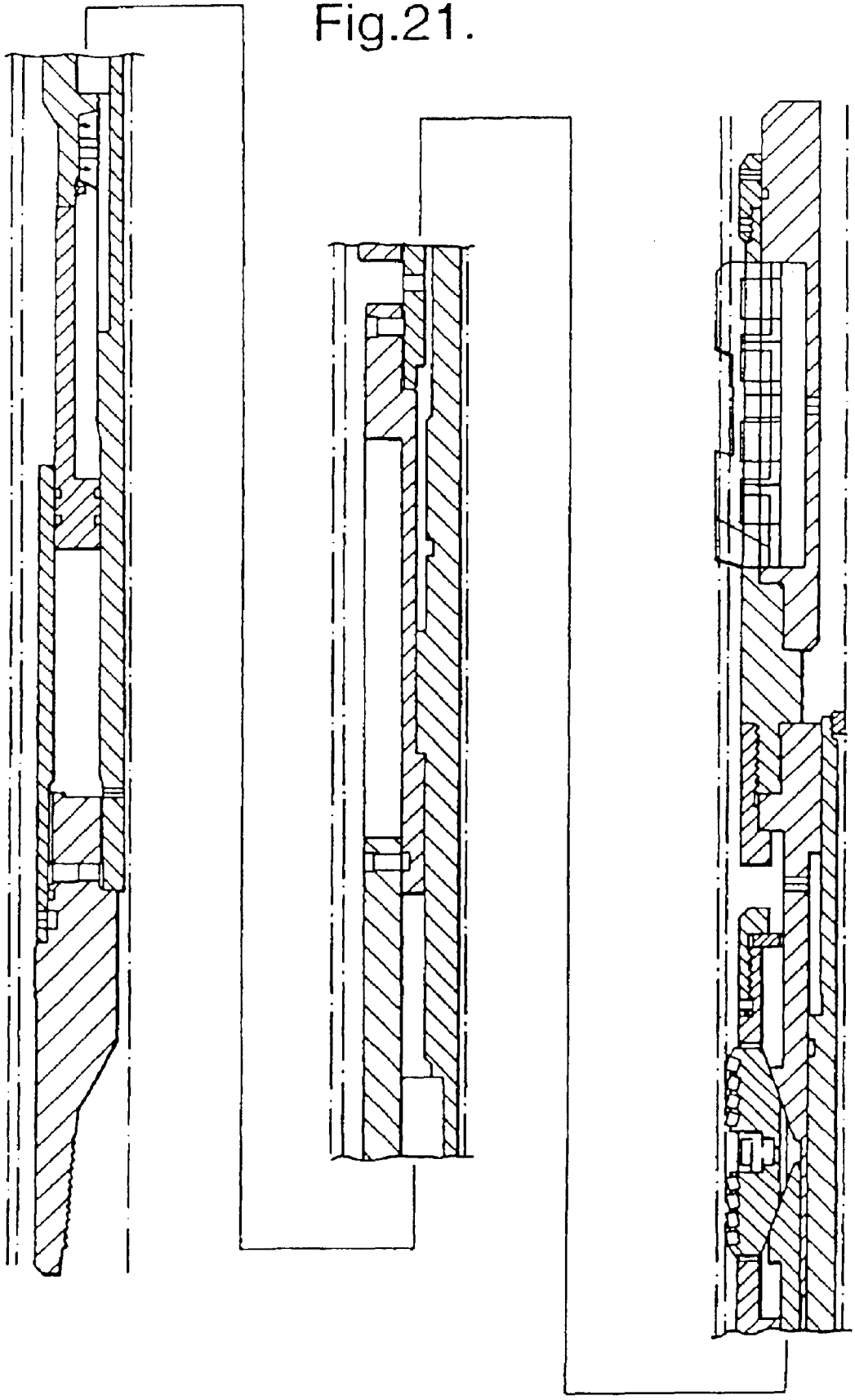
Figure 22:
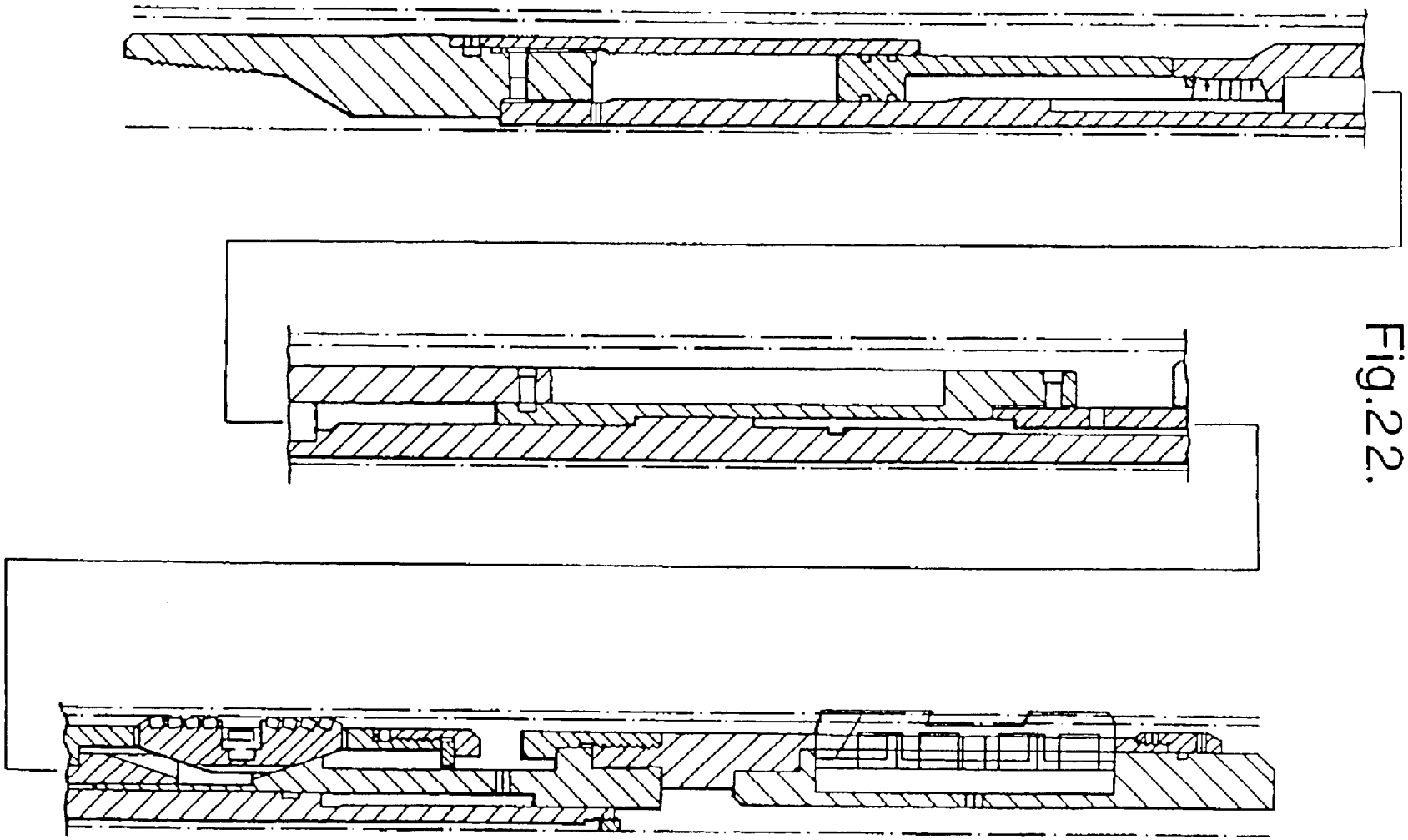

With regard to FIGS. 11 and 12, both systems are hydraulically activated in principle, however limitations in setting pressures/sequences mean that the latch cannot be activated independently of the packer—when the bypass valve closes the string pressures up, virtually uncontrollably and both tools would set, the packer setting would prevent us from engaging the latch and in actual fact, the latch with element on its own, would suffer similar problems without some significant sequencing device to ensure the pack off stayed relaxed until we need it activated.

The need for the element to be actuated (since we do not actually need the anchor/packer slip element) is to isolate the lower leg from losses.

The sequence of operation would therefore be to orient the system with MWD circulating the string through the BPV. Then close the BPV to pressure the string and activate the latch. Engage the latch in the coupling. Check orientation if required, this would need the BPV to be cycled open to circulate for MWD survey, close again and set pack off element. Naturally a second survey is not necessary, and once the latch is engaged, the pack off element can be set.

The following section relates to the latch which engages a profile downhole and which is run in conjunction with a hydraulically set pack-off assembly (see FIGS. 18 to 22). It is to be noted that the latch system can also be set mechanically as well as hydraulically, though this system description only covers the hydraulic activation of the pack-off assembly. The pack-off assembly you will note has slips and lock ring to retain the whole latch assembly, including the locator in its profile whilst the system is being unset and released for recovery up hole. The latch locator is run and set in its profile by pulling it back through the profile such that it may cam (orient) itself with a known amount of overpull as the dog is biased by springs, subject to the profile it may have a surface indicator which comprises a bar or gate prior to entry into the profile proper, which gives a preliminary indication of depth location, once in the profile the normal method of confirming location is to set down weight. No movement down with a significant amount of weight is the method of confirming location, to pass through a profile if inadvertently located would require picking up through it, rotating a few degrees to misalign the components and then go down. Usually this is not necessary. Once located in the profile with the nominal overpull, which may be of the order of 20000 lbs, (variable), the set down weight would be up to 100000 lbs subject to design loads. This allows a whipstock to be located and sheared off in a downward direction, upward will release from the locator, and the window milled accordingly. The system can transmit torsional loads as well. The locator on any of the systems does not incorporate a packer or pack off element, and to protect the well bore from cuttings, and fluid losses to the formation below, indeed, to protect the latch assembly, from debris will require some form of barrier. The barriers to date are usually cup type with fluid bypass areas, through or around which do not totally close off the annular area in the casing. As is consistent with our theme of whipstock technology, we can therefore hydraulically set the pack-off system as described below.

1. Once the latch has engaged and weight set down to ensure proper engagement, the packer can be set by applying pressure. (NPT plug in bottom of mandrel). The piston will move down engage the lock ring housing and shear the top shear screw. The piston will continue to move down and set the element.

2. The second shear screws will then shear, moving the upper cone underneath the slips forcing them out of the cage. The slips will rid up the lower cone and bite into the casing. The packer is now set and will remain so due to the lock ring on the mandrel. Note, the element can be set after the slips are energised.

3. When it is time to retrieve the assembly, pick up and shear the lower screws. This will close the gap between the key and the shoulder on the key slot on the mandrel.

4. Continue to pick up and the lock ring housing will be lifted up which will allow the element to collapse.

5. The shoulder on the mandrel will then contact the internal shoulder in the packer sleeve. This will pull the upper cone from underneath the slips which will now collapse into the cage.

6. The assembly will continue to be picked up until overpull is achieved to snap the latch dog from the profile. Internal shoulder on the lower cone will allow weight down on the mandrel when running in hole which will stop premature shearing of screws. Also spline between the lower cone and the mandrel throughout the running and retrieving sequence which will maintain orientation.

The mechanical set version (see FIGS. 13 to 17) can be set as follows:

1. Again the assembly is latched into the profile.

2. Weight is then set down on the top sub which will shear the first set of screws.

3. The second set will shear releasing the upper cone which will slide underneath the slips, pushing them out of the cage and into the casing.

4. The screws between the lock ring housing and the packer sleeve will shear next and this will then compress the pack-off element. The packer is now set and again remains so due to the lock ring on the mandrel.

5. When it comes to releasing the packer, pick-up and shear out the screws between the mandrel and the lower cone.

6. The top sub, lock ring housing, lock ring and mandrel will be picked up at this stage allowing the element to collapse.

7. The shoulder on the mandrel will then contact the inner shoulder on the packer sleeve. This will pick up the packer sleeve and the upper cone which will move upwards from underneath the slips allowing them to collapse.

8. The shoulder on the upper cone will contact the shoulder on the slip cage and the assembly will move up until the retrieving ring contacts the shoulder on the lower cone.

9. This will now allow to pickup until there is enough force to collapse the dog in the latch to pull the assembly out of the profile.

The mechanical set version performs the same task, but obviously is more sensitive to the loads applied to the locator assembly when passing through couplings (profile subs), and therefore there is a need to stage the shear loads such that the locator engagement is confirmed, the pack-off system is set and finally the milling assembly is sheared off the whipstock to enable a window to be cut, the system including whipstock in both cases may be run independently of the whipstock if so desired.

Figure 7:
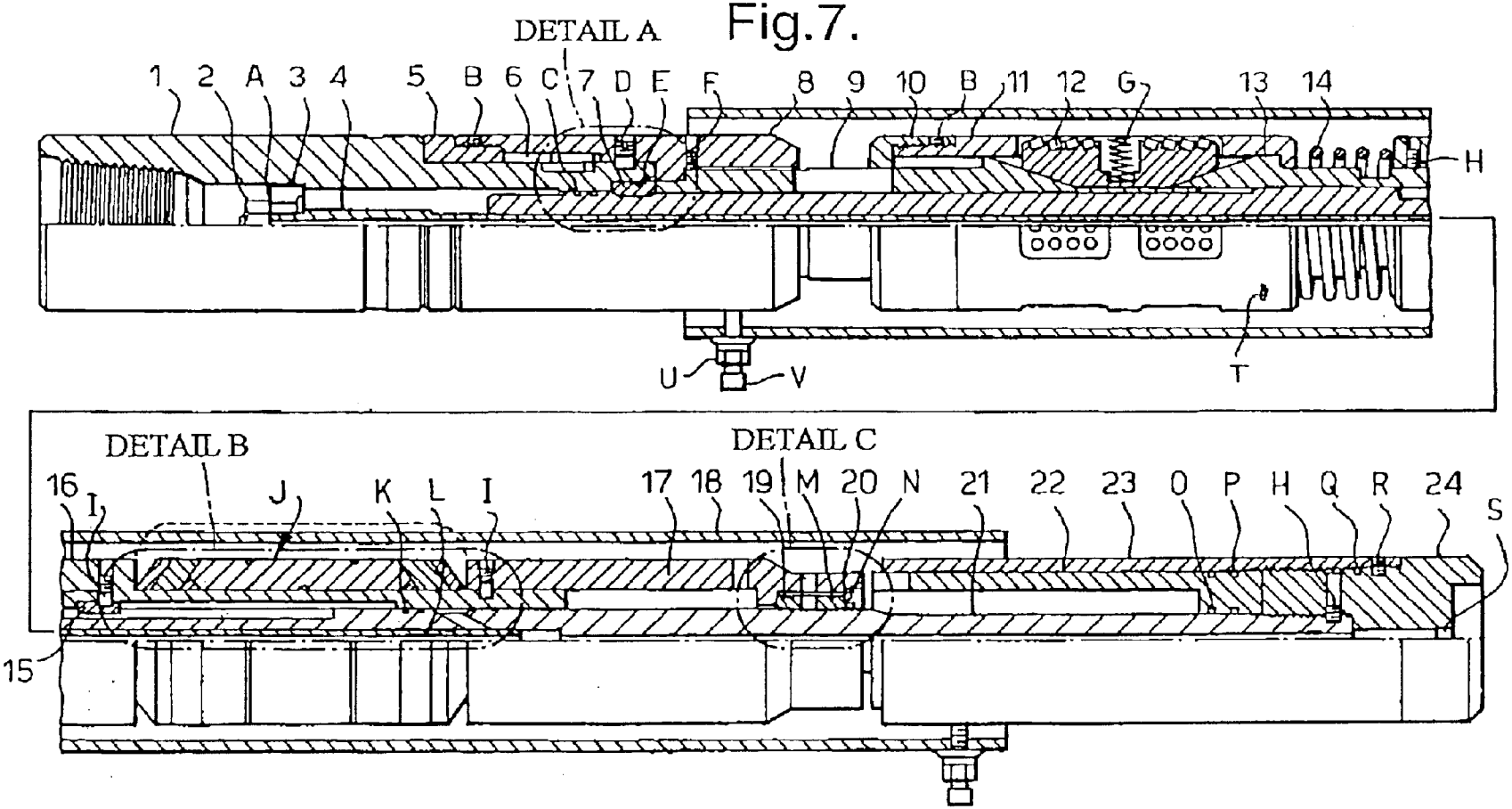
FIG. 7 is a cross-section view of a hydraulically set retrievable whipstock packer for use in conjunction with a latch, wherein slips 12 of the packer are located up-hole of the packer element J.
Figure 8:
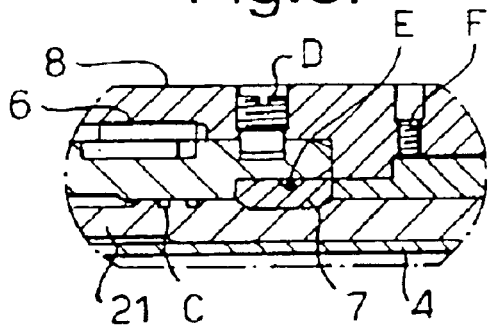
FIGS. 8, 9 and 10 show details A, B and C of FIG. 7.
Figure 9:
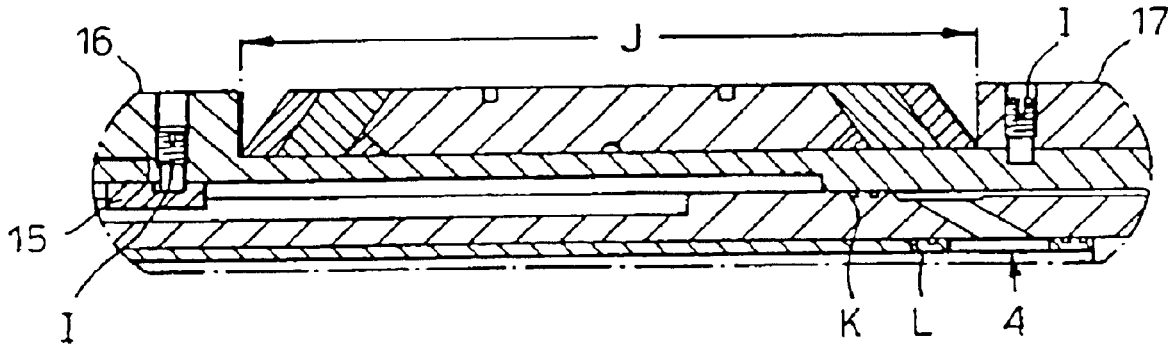
Figure 10:
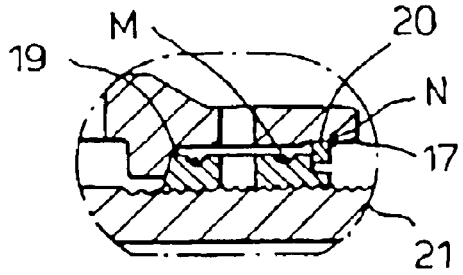

Notes regarding FIGS. 7, 8. 9 and 10

FILL INTERNAL VOID AREAS WITH MULTI-PURPOSES GREASE

| ITEM | DESCRIPTION | QTY. |
|---|---|---|
| V | HEX NUT | 5 |
| U | SOC HD CAP SCREW | 5 |
| T | SHEAR SCREW | 4 |
| S | PIPE PLUG | 1 |
| R | SET SCREW | 2 |
| Q | O-RING | 1 |
| P | O-RING | 2 |
| O | O-RING | 2 |
| N | SNAP RING | 1 |
| M | GARTER SPRING | 2 |
| L | O-RING | 4 |
| K | O-RING | 2 |

-continued

| ITEM | DESCRIPTION | QTY. |
|---|---|---|
| J | PACKING ELEMENT | 1 |
| I | SHEAR SCREW, LOWER CONE | 13 |
| H | SET SCREW | 3 |
| G | SPRING SLIP | 4 |
| F | SET SCREW | 2 |
| E | GARTER SPRING | 1 |
| D | SHEAR SCREW, RELEASE | 4 |
| C | O-RING | 2 |
| B | SET SCREW | 3 |
| A | SNAP RING | 1 |
| 24 | NOSE | 1 |
| 23 | PISTON CYLINDER | 1 |
| 22 | PISTON | 1 |
| 21 | MANDREL | 1 |
| 20 | RETAINING RING | 1 |
| 19 | LOCKING NUT | 1 |
| 18 | SHIPPING CONTAINER | 1 |
| 17 | LOCKING NUT HOUSING | 1 |
| 16 | PACKER SLEEVE | 1 |
| 15 | MANDREL RETAINING RING | 1 |
| 14 | SPRING LOWER CONE PRELOAD | 1 |
| 13 | LOWER CONE | 1 |
| 12 | SLIP | 4 |
| 11 | SLIP BODY | 1 |
| 10 | SLIP BODY NUT | 1 |
| 9 | UPPER CONE | 1 |
| 8 | RELEASE ADAPTER | 1 |
| 7 | LOCKING COLLET | 1 |
| 6 | RELEASE KEY | 3 |
| 5 | RELEASE ADAPTER CAP | 1 |
| 4 | BY-PASS ROD | 1 |
| 3 | BY-PASS ROD RETAINER | 1 |
| 2 | HEX NUT | 1 |
| 1 | ADAPTER SUB | 1 |

What is claimed is:

1. A downhole system for locating and fixing equipment at a required depth and orientation within a wellbore, the system comprising a portion of well bore casing having an inner surface in which a latch profile is defined; and downhole apparatus comprising a latch sub for locating equipment secured thereto at a required depth and orientation, and an anchor packer for releasably fixing the depth and orientation of said latch sub relative to a well bore, said equipment being secured to the latch sub by means of a first connection between said equipment and the anchor packer and a second connection between the anchor packer and the latch sub, wherein the first and second connections prevent relative movement between the connected components, the latch sub comprising a body and a latching member mounted on said body so as to be movable between a retracted position and an extended position, the latching member projecting a greater radial distance from said body when in the extended position than when in the retracted position, wherein the latching member is adapted to project into said latch profile provided in said portion of well bore casing when in the extended position during use and wherein a first portion of said latch profile is adapted to be engaged by the latching member in such a way that, when pressed against said profile portion, the latching member tends to slide along a well bore casing edge defining said profile portion so as to locate the latching member in abutment with a second profile portion and thereby prevent further movement of the latch sub in the direction of pressing, the latching member being further adapted to engage a third portion of said profile in such a way that, when pressed against said third profile portion, the latching member is moved towards the retracted position so as to permit movement of the downhole apparatus past said latch profile.

2. A downhole system as claimed in claim 1, wherein a downhole portion of said latch profile is of a V-shape.

3. A downhole system as claimed in claim 1 or 2, wherein said anchor packer is a weight set anchor packer.

4. A downhole system as claimed in claim 1, wherein the anchor packer is located between the latch sub and said equipment.

5. A method of positioning downhole equipment within a well bore, the method comprising the steps of providing a latch profile in the wall of the well bore or well bore casing; determining the position and orientation of said latch profile; making up a string comprising an anchor packer, a latch sub and equipment to be positioned within the well bore, said equipment secured to the latch sub by means of a first connection between said equipment and the anchor packer and a second connection between the anchor Packer and the latch sub, wherein the first and second connections prevent relative movement between the connected components, the latch sub comprising a latch member for locating in said latch profile and said equipment being positioned and orientated relative to the latch member in view of said determination so as to ensure a desired position and orientation of said equipment is achieved in the well bore when the latch member is located in said latch profile; running the string downhole; locating the latch member in said latch profile; sliding the latch member along an edge of said latch profile until a portion of said latch profile stops said sliding movement; and setting said anchor packer.

* * * * *